United States Patent [19]

Michetti

[11] 4,088,263

[45] May 9, 1978

[54] SEAL END CARTON CORNER CONSTRUCTION

[75] Inventor: Louis C. Michetti, Santa Clara, Calif.

[73] Assignee: Container Corporation of America, Chicago, Ill.

[21] Appl. No.: 814,200

[22] Filed: Jul. 11, 1977

[51] Int. Cl.[2] ..... B65D 5/02
[52] U.S. Cl. ..... 229/37 R
[58] Field of Search ..... 229/37 R

[56] References Cited

U.S. PATENT DOCUMENTS

| | | | |
|---|---|---|---|
| 1,673,109 | 6/1928 | Fenstermacher | 229/37 R |
| 1,921,150 | 8/1933 | Bomberger | 229/37 R |
| 2,187,304 | 1/1940 | Farmer | 229/37 R |
| 2,769,589 | 11/1956 | Moore | 229/37 R |
| 3,035,750 | 5/1962 | Kauffeld | 229/37 R |

*Primary Examiner*—Davis T. Moorhead
*Attorney, Agent, or Firm*—Carpenter & Ostis

[57] ABSTRACT

A seal end paperboard carton having a corner construction wherein the inner closure flaps are cut to permit their deflection to provide a substantially flat plane between panel surfaces which underlie the outer closure flap.

2 Claims, 5 Drawing Figures

SEAL END CARTON CORNER CONSTRUCTION

SUMMARY OF THE INVENTION

This invention relates to folding cartons and particularly to seal end paperboard cartons having inner, intermediate, and outer closure flaps secured to each other in overlapped relation.

It is an object of the invention to provide, in a carton of the type described, a closure arrangement wherein the inner and intermediate closure flaps present co-planar upper surfaces which contact the lower surface of the outer closure flap to eliminate any gaps or spaces therebetween.

In the past, this has been accomplished by embossing or debossing portions of the intermediate or inner closure flaps. It is believed, however, that the present invention accomplishes this objective in an improved manner by providing a cut in each inner flap which underlies an angled edge portion in the intermediate flap, thus permitting the inner flap to deflect when the carton is closed with the flaps secured to each other in overlapped relation.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
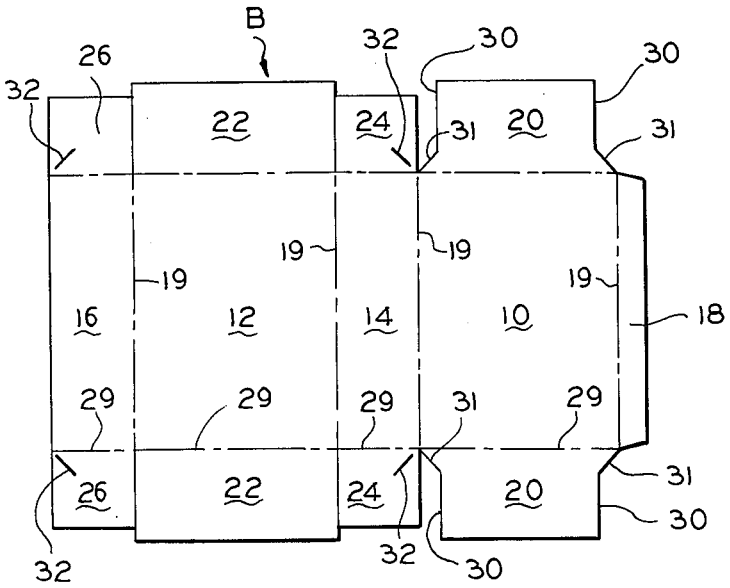
FIG. 1 is a plan view of the blank from which the carton illustrated in FIG. 2 may be formed.
Figure 2:
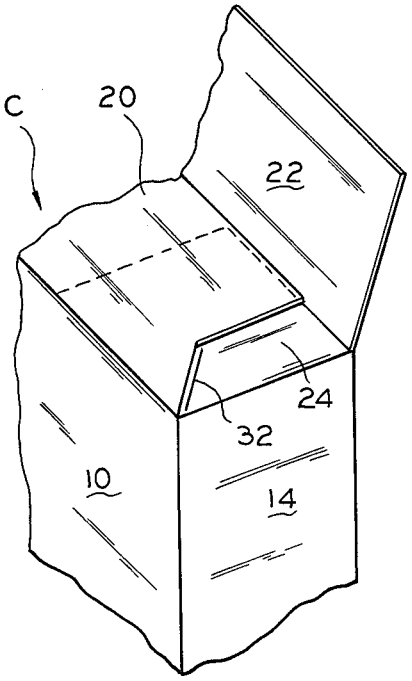
FIG. 2 is a fragmentary, perspective view of a carton having a closure arrangement embodying features of the invention.

Referring now to the drawings for a better understanding of the invention, it will be seen that the novel carton, indicated generally at C and illustrated in FIG. 2, may be formed from the unitary blank B of paperboard illustrated in FIG. 1.

The carton is a seal end carton which includes opposed pairs of major and minor side wall panels hingedly interconnected to form a tubular structure. As best seen in FIG. 2, the body portion of the carton blank B includes a pair of major side wall panels 10 and 12, a pair of minor side wall panels 14 and 16, and a glue panel 18 which are foldably joined to each other along parallel fold lines 19 to form a tubular structure open at the ends.

Closure means are provided at each end of the carton in the form of a plurality of closure flaps secured to each other in overlapped relation.

Still referring to FIG. 1, it will be seen that each set of closure flaps includes an intermediate closure flap 20 joined to a major side wall panel 10, an outer closure flap 22 foldably joined to another side wall panel 12, and a pair of inner closure flaps 24 and 26 foldably joined to related end edges of minor side wall panels 14 and 16 respectively. All of the closure flaps are joined to the end edges of their respective side and end wall panels along aligned fold lines 29 which extend longitudinally of the blank B.

In the embodiment illustrated in FIG. 1, flaps 20 at each end of the carton are considered the intermediate closure flaps and are each provided at each side thereof with a recess 30 cut therefrom which includes at least one edge portion 31 which extends from an inner corner of said intermediate flap along a line which forms an angle of less than 90° with fold line 29 joining intermediate flap 20 to its related major side wall panel 10. Each outer closure flap 22 is generally rectangular and is co-extensive with the cross sectional area of the tubular structure so as to completely cover the end of the carton when in the closed position.

Each of the inner flaps 24 and 26 are also generally rectangular and are each provided at a corner adjacent the intermediate flap 20 with a cut 32 which extends from a point spaced a slight distance inwardly from the corner of the flap and which forms an angle of less than 90° with the related fold line 29. If desired, edge portions 31 and cut lines 32 may be curved slightly (not shown) to eliminate webbing problems sometimes caused by straight cutting knives.

As best seen in FIG. 2, when the carton is closed with the intermediate flap being folded over on top of the inner flaps, the cut lines 32 of the inner flaps underlie the adjacent edge portions 31 of the intermediate flaps. The purpose of this is to permit the portions of the inner flaps which underlie the intermediate flap to deflect downwardly or into the package slightly so that the remaining portions of the inner flaps which are exposed to contact with the inner surface of the outer flap, lie substantially in a common plane with the upper surface of the intermediate flap. Thus when the outer flap is folded over on top of the intermediate and inner flaps and adhesively secured thereto (not shown in drawing) in a conventional manner, there will be no gaps or cracks which would permit infestation between the flaps of the closure and into the carton. Also, it will be noted that the cut lines 32 in the inner closure flaps do not start at the exact inner corners of the flaps, but start at a point spaced a slight distance from the corner, and this is also a means of preventing pin holing which could possibly permit infestation in the corner of the carton.

Figure 3:
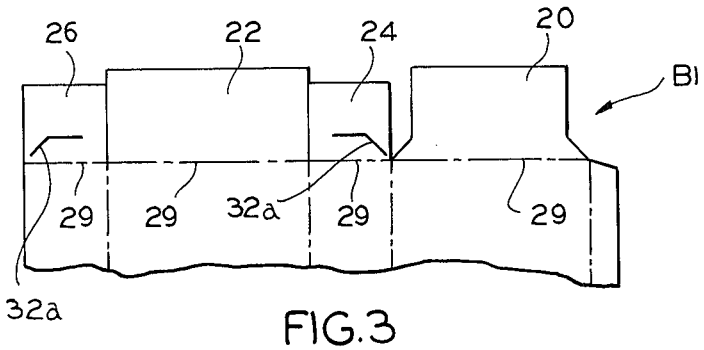
FIGS. 3 and 4 are views similar to those of FIGS. 1 and 2 respectively, but illustrate a slightly modified form of the invention.
Figure 4:
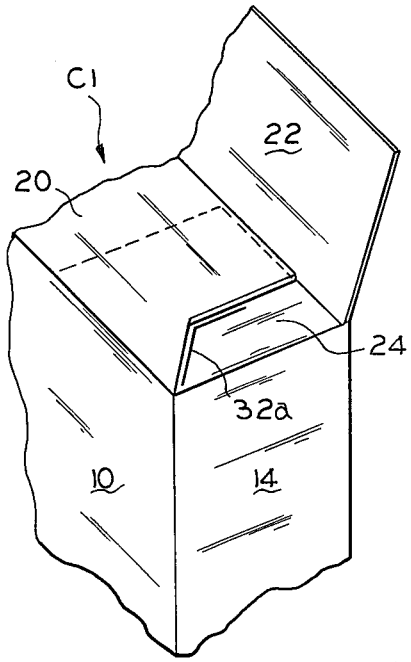

Turning now to FIGS. 3 and 4 where a slight modified form of the invention is shown, it will be seen that the carton is of similar construction to the previous embodiment, except that the cuts **32*a*** in the inner closure flaps each include two sections which form an angle with each other of more than 90° but less than 180°, and that each portion of each cut underlies a related edge portion of the intermediate closure flap.

Figure 5:
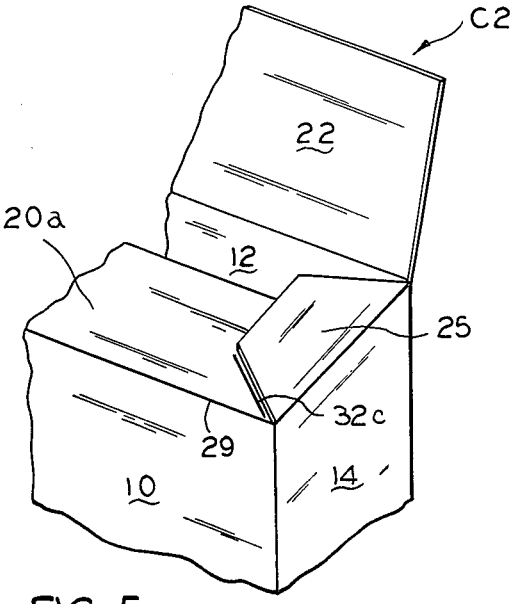
FIG. 5 is a view similar to that of FIG. 4 but illustrating yet another modification of the invention.

Turning now to FIG. 5 where a slightly modified form of the invention is shown, it will be seen there is provided a single inner closure flap **20*a* which is foldably joined to a major side wall panel 10 along fold line 29, and a pair of intermediate closure flaps 25 which are foldably joined along fold lines 29 to the related end edges of minor side wall panels 14 and 16. In this case the cut 32*c* is formed at each end of the inner closure flap 20*a* and underlies a sloping edge portion of a related intermediate closure flap 25**.

In all three embodiments of the invention, the effect of the relationship between the cut of an inner flap and the edge portion of an intermediate flap permits deflection of the inner flap to present generally flat, co-planar services on the inner and intermediate flaps for adhesive connection to the inner surface of the outer flap.

I claim:

1. In an infestation proof, collapsible, seal end folding carton formed of a unitary blank of foldable paperboard, the combination of:

(a) opposed pairs of major and minor side walls foldably joined along parallel fold lines to form a tubular structure;

(b) closure means at one end of said tubular structure comprising a set of opposed pairs of closure flaps foldably joined to end edges of respective major and minor side walls;

(c) each set of closure flaps being secured to each other in overlapped relation and including:

(i) at least one inner closure flap;

(ii) at least one intermediate closure flap;

(iii) one outer closure flap;

(d) said outer closure flap being substantially rectangular and being co-extensive with the end of said tubular structure;

(e) said intermediate closure flap having at at least one side thereof a recess which exposes an upper surface of said inner flap and which has an edge portion extending from an inner corner of said intermediate flap along a line which forms an angle of less than 90° with the fold line joining said intermediate flap to its respective side wall;

(f) said inner closure flap having therein a cut extending from a point spaced a slight distance from the inner corner of said inner flap adjacent said intermediate panel and underlying said related edge portion of said intermediate panel recess to facilitate deflection of said inner panel and thereby provide a substantially flat plane between the upper surfaces of the portions of the inner and intermediate flaps which contact the lower surface of the outer flap.

2. In an infestation proof, collapsible, seal end folding carton formed of a unitary blank of foldable paperboard, the combination of:

(a) opposed pairs of major and minor side walls foldably joined along parallel fold lines to form a tubular structure;

(b) closure means at one end of said tubular structure comprising a set of opposed pairs of closure flaps foldably joined to end edges of respective major and minor side walls;

(c) each set of closure flaps being secured to each other in overlapped relation and including:

(i) a pair of inner closure flaps;

(ii) an intermediate closure flap;

(iii) an outer closure flap;

(d) said outer closure flap being substantially rectangular and being co-extensive with the end of said tubular structure;

(e) said intermediate closure flap being generally rectangular but having at opposed sides thereof, recesses which expose upper surfaces of said inner flap, each of which has an edge portion extending from an inner corner of said intermediate flap along a line which forms an angle of less than 90° with the fold line joining said intermediate flap to its respective side wall;

(f) said inner closure flaps being generally rectangular and each having therein a cut extending from a point spaced a slight distance from the inner corner of said inner flap adjacent said intermediate panel and underlying said related edge portion of said intermediate panel recess to facilitate deflection of said inner panel and thereby provide a substantially flat plane between the upper surfaces of the portions of the inner and intermediate flaps which contact the lower surface of the outer flap.

* * * * *